US005577468A

United States Patent [19]

Weber

[11] Patent Number: 5,577,468

[45] Date of Patent: Nov. 26, 1996

[54] ENGINE VALVE SEATING VELOCITY HYDRAULIC SNUBBER

[75] Inventor: J. Roger Weber, Chillicothe, Ill.

[73] Assignee: Caterpillar Inc., Peoria, Ill.

[21] Appl. No.: 244,338

[22] PCT Filed: Nov. 29, 1991

[86] PCT No.: PCT/US91/08886

§ 371 Date: Nov. 29, 1991

§ 102(e) Date: Nov. 29, 1991

[51] Int. Cl.[6] ..... F01L 9/02

[52] U.S. Cl. ..... 123/90.12; 123/90.49

[58] Field of Search ..... 123/90.12, 90.13, 123/90.16, 90.48, 90.49

[56] References Cited

U.S. PATENT DOCUMENTS

| | | | |
|---|---|---|---|
| 3,119,592 | 1/1964 | Fraschetti | 251/57 |
| 3,209,737 | 10/1965 | Omotehara et al. | 123/90.12 |
| 3,672,628 | 6/1972 | Aanstad | 251/47 |
| 3,844,528 | 10/1974 | Massie | 251/30 |
| 3,938,483 | 2/1976 | Firey | 123/90.12 |
| 4,552,330 | 11/1985 | Grotioh | 251/30.01 |
| 4,694,787 | 9/1987 | Rhoads | 123/90.13 |
| 4,796,573 | 1/1989 | Wakeman et al. | 123/90.16 |
| 4,838,403 | 6/1989 | Layer | 192/141 |
| 4,860,571 | 8/1989 | Smedberg et al. | 72/453.13 |
| 4,889,085 | 12/1989 | Yagi et al. | 123/90.12 |
| 4,936,226 | 6/1990 | Wiebe | 105/198.3 |
| 4,948,049 | 8/1990 | Brisbon et al. | 239/91 |
| 4,964,462 | 10/1990 | Smith | 166/255 |
| 5,012,785 | 5/1991 | Long et al. | 123/467 |
| 5,088,458 | 2/1992 | Wakeman et al. | 123/90.49 |
| 5,113,812 | 5/1992 | Rembold et al. | 123/90.12 |
| 5,127,375 | 7/1992 | Bowman et al. | 123/90.12 |
| 5,158,048 | 10/1992 | Robnett et al. | 123/90.16 |
| 5,193,495 | 3/1993 | Wood, III | 123/90.12 |
| 5,216,988 | 6/1993 | Taxon | 123/90.12 |
| 5,221,072 | 6/1993 | Erickson et al. | 251/30.05 |
| 5,255,641 | 10/1993 | Schechter | 123/90.12 |
| 5,275,136 | 1/1994 | Schechter et al. | 123/90.12 |

FOREIGN PATENT DOCUMENTS

| | | |
|---|---|---|
| 2252023 | 6/1975 | France . |
| 1250677 | 9/1967 | Germany . |
| 1962916 | 6/1971 | Germany . |
| 2006844 | 8/1971 | Germany . |
| 2057667 | 6/1972 | Germany . |
| 59-229011 | 12/1984 | Japan . |
| 60-085208 | 5/1985 | Japan . |
| 60-252111 | 12/1985 | Japan . |
| 60-259713 | 12/1985 | Japan . |
| 62-041907 | 2/1987 | Japan . |
| 87/07677 | 12/1987 | WIPO . |

*Primary Examiner*—Weilun Lo

*Attorney, Agent, or Firm*—Dennis C. Skarvan; Joseph W. Keen

[57] ABSTRACT

The invention described herein is a system (5) and method for opening an engine valve (12) by hydraulic force and for slowing the engine valve (12) by hydraulic force to an acceptable impact velocity when the engine valve (12) closes. Basically, a snubbing valve (10) is situated between the rail (40) that transports the high pressure hydraulic fluid needed to open the engine valve (12) and the engine valve (12). The snubbing valve (10) allows relatively unrestricted flow of the fluid in the direction from the rail (40) to the engine valve (12) so that adequate high pressure fluid can be provided to quickly open the engine valve (12). When the engine valve (12) returns towards the closed position under the force of a return spring (72) the snubbing valve (10) then restricts the flow of fluid out of the cavity (52) between the snubbing valve (10) and the engine valve (12) so as to slow the engine valve (12) to an acceptable impact velocity.

7 Claims, 3 Drawing Sheets

ENGINE VALVE SEATING VELOCITY HYDRAULIC SNUBBER

TECHNICAL FIELD

Hydraulically actuated engine poppet valves, and more particularly, hydraulically actuated engine poppet valves having a hydraulic snubber for decelerating the valve during valve closing to an acceptable impact velocity before the valve contacts the valve seat.

BACKGROUND ART

Engine combustion chamber valves are almost universally of a poppet type. A number of means exist for opening such valves including a cam on a rotating cam shaft, hydraulic pressure, electromagnetics, and others. Hydraulically actuated valves are typically spring loaded toward a valve-closed position and opened against the spring bias by the hydraulic pressure.

Because the valve should open and close very quickly, the spring is typically very stiff and is loaded to a high force under the relatively high hydraulic pressure needed to open the valve quickly against the high internal pressures of the combustion chamber. Therefore, when the valve closes, it impacts the valve seat at velocities that can create forces which eventually erode the valve or the valve seat or even fracture or break the valve.

Therefore, it is an object of the present invention to provide a means whereby the valve will be slowed or snubbed as it nears the valve seat so that the valve seats at an acceptable velocity.

It is an additional object of the present invention to provide a hydraulically actuated poppet valve having a snubbing valve positioned upstream therefrom, wherein the snubbing valve restricts fluid flow exiting the hydraulic cavity between the engine valve and the snubbing valve as the engine valve closes, thereby slowing the engine valve to an acceptable impact velocity.

DISCLOSURE OF THE INVENTION

In a first aspect of the present invention, a system is provided for opening an engine valve by hydraulic force and for slowing the engine valve by hydraulic force to an acceptable impact velocity when the engine valve closes. The engine valve is biased towards its closed position by a return spring. A rail communicates high pressure fluid to a first end of the engine valve for opening the engine valve against the spring bias force. Situated between the rail and the first end of the engine valve is a snubbing valve. The snubbing valve and its surrounding structures are adapted to allow relatively unrestricted flow of the high pressure fluid from the rail to the first end of the engine valve to quickly open the engine valve.

When the engine valve is to return to its closed position, communication of the high pressure fluid with the rail is ceased. The force of the return spring then causes the engine valve to return towards its closed position. The snubbing valve and its surrounding structures are also adapted to then restrict the flow of fluid from the cavity between the snubbing valve and the first end of the engine valve to a rate that will maintain hydraulic pressure in the cavity adequate to slow the engine valve to an acceptable impact velocity as it closes.

In a preferred embodiment, the snubbing valve includes a check displaceable between a first seat and a second seat. When high pressure fluid is in the rail, the check seats against the first seat and the check and first seat are adapted to allow relatively unrestricted flow of the fluid to the first end of the engine valve. When communication of the high pressure fluid to the rail ends, the differential hydraulic pressure between the relatively high pressure fluid still in the cavity between the snubbing valve and the first end of the engine valve and the relatively low pressure fluid now in the rail causes the check to seat against the second seat. The check and the second seat are adapted to then restrict the flow of fluid being essentially pumped out of the cavity by the return of the engine valve to a rate that will maintain hydraulic pressure in the cavity adequate to slow the engine valve to an acceptable impact velocity.

In a second aspect of the present invention, a method for performing the above described functions is provided.

BEST MODE FOR CARRYING OUT THE INVENTION

Figure 1:
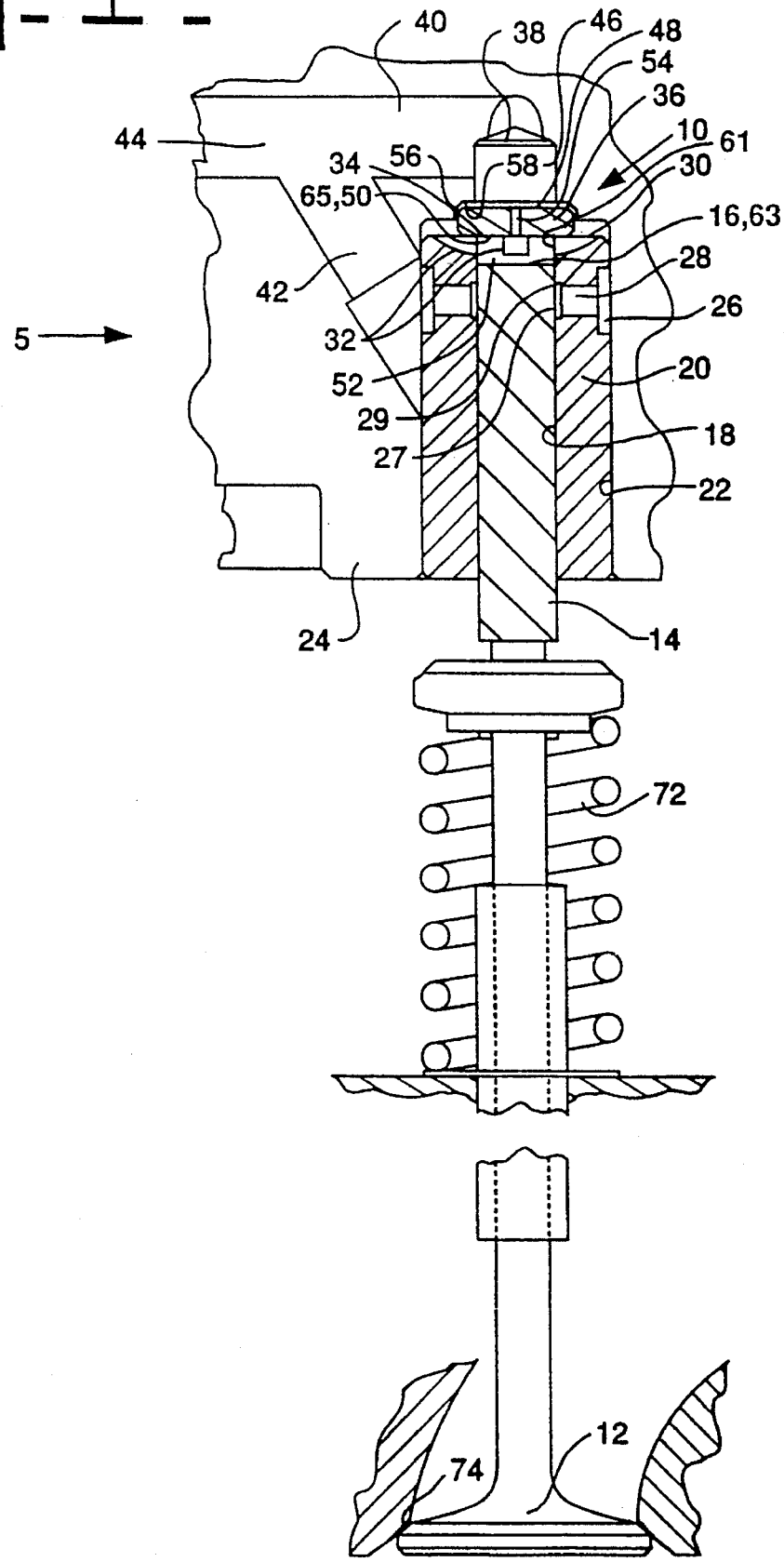
FIG. 1 is an elevational cross-sectional view of a preferred embodiment of a system of the present invention.

Referring now to FIG. 1, a preferred embodiment of a system 5 for hydraulically slowing a moving member 12, in this case an engine poppet valve, by use of a snubbing valve 10 is shown. The engine poppet valve 12 includes a plunger 14 having a first end 16. The poppet valve 12 typically has circular cross-sections and can be made from a number of well-known materials. The poppet valve 12 moves in a longitudinal direction; down to open and up to close. The plunger 14 rides in the bore 18 of an insert 20 which is press-fitted into a bore 22 in the engine valve body 24.

The insert 20 has a first annulus 26 about its circumference and four lateral bores 28 (only two of which are shown) which communicate the annulus 26 with the plunger bore 18. The insert 20 has a second annulus 27 about the bore 18 having a metering edge 29. The first end 30 of the insert 20 has a pair of keyhole slots 32 cut therein, perpendicular to each other. The insert material between the keyhole slots 32 forms a first seat 34 for the check 36 of the snubbing valve 10, as later described. Communicating with the top 38 of the plunger bore 18 is a first rail 40 and communicating with the annulus of the insert is a second rail 42, the rails being for passing hydraulic fluid. In the embodiment shown, the first and second rails 40,42 are two prongs extending from a common rail 44, however, in other embodiments they could extend from separate sources.

Adjacent the first end 46 of the first rail 40 is the snubbing valve 10. At the second end (not shown) of the common rail 44 is a valve, for example, a spool valve, for selectively communicating high or low pressure fluid through the common rail 44. In this embodiment, the snubbing valve 10 basically includes a check 36 (in this case a flat check) and the physical structures in the immediate vicinity of the check (in this case the engine valve body 24 and insert 20). The check 36 has a top 48 adjacent the second end 46 of the first rail 40 and a bottom 50 adjacent a hydraulic cavity 52. The hydraulic cavity is defined by walls 61 and has a first end 63 adjacent the first end 16 of the plunger 14 and a second end 65 adjacent the bottom 50 of the check 36. The check 36 has a circular cross-section and a restricted flow passage 54, in this case a snubbing orifice, therethrough. The space between the first end 16 of the plunger 14 and the bottom 50 of the check 36 is the hydraulic cavity 52.

The check 36 and the physical structures in the vicinity of the check 36 are adapted to control the relatively free flow of fluid from the first rail 40 to the hydraulic cavity 52 and the relatively restricted flow of fluid from the hydraulic cavity 52 to the first rail 40, as later described. As used herein, the term "check" refers to a member which is seated or unseated by the force of hydraulic pressure to allow fluid flow between two spaces (in this case the first rail 40 and the hydraulic cavity 52). As used herein, the term "restricted flow" means that the rate of fluid flow permitted out of the hydraulic cavity 52 is a rate that will maintain hydraulic pressure in the hydraulic cavity 52 of sufficient magnitude to slow the engine valve 12 when the engine valve 12 is moving in the direction from the second (open) position toward the first (closed) position.

The bore 22 in the valve body 24 is stepped to prevent the check 36 from moving laterally. The insert 20 is press-fitted into the valve body 24 a distance that will allow the check 36 slight longitudinal displacement. The check 36 is displaceable between a first position whereat the bottom 50 of the check 36 is seated against the first seat 34 and a second position whereat the top 48 of the check 36 is seated against the second seat 58. When the check 36 is seated against the first seat 34, flow passages 56 are opened around the check 36 to allow fluid to flow relatively freely from the first rail 40 into the hydraulic cavity 52. When the top 48 of the check 36 is seated on the second seat 58, the flow passages 56 at the sides of the check 36 are closed and the snubbing passage 54 acts as a restricted flow passage.

Figure 2:
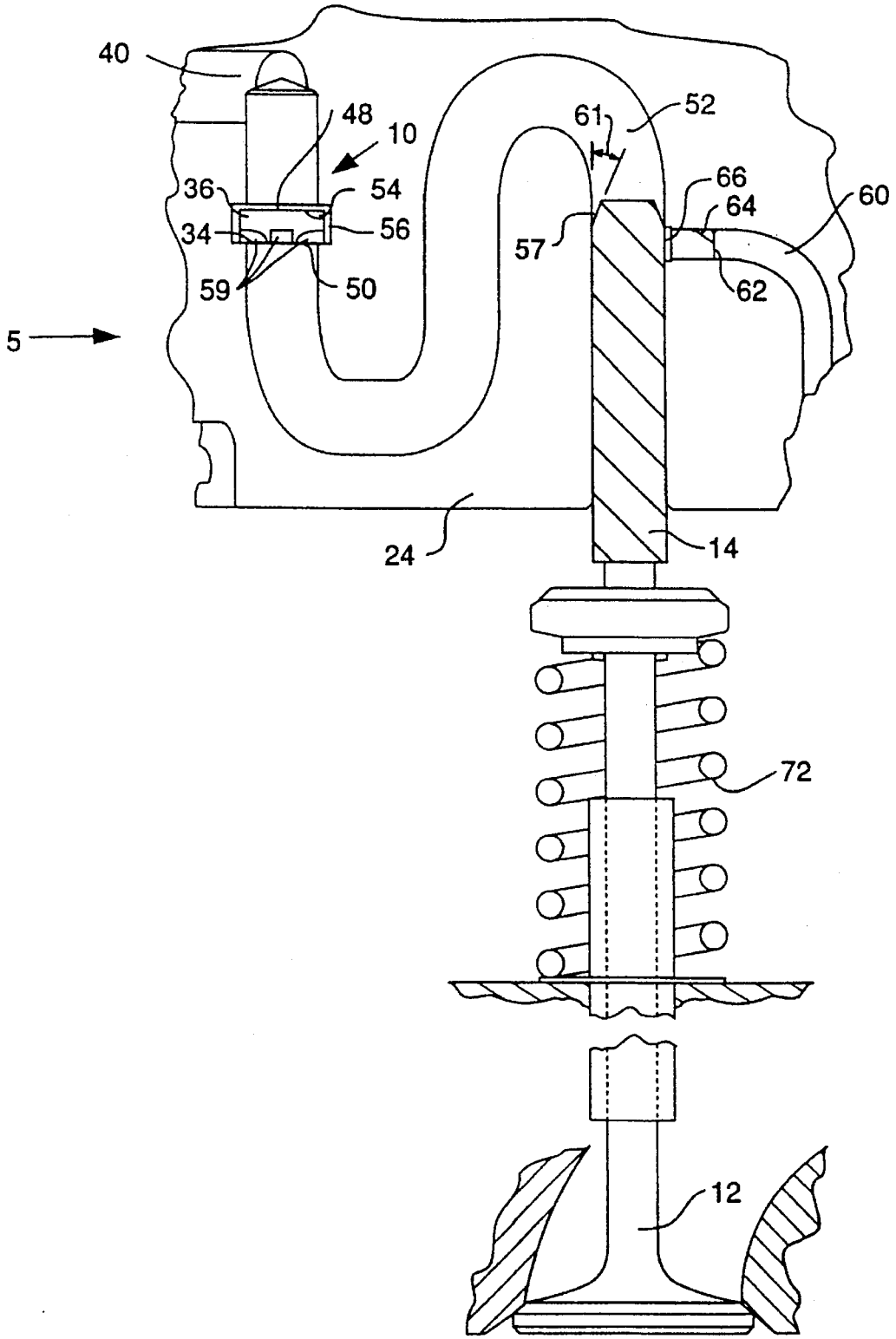
FIG. 2 is an elevational cross-sectional view of an alternative embodiment of a system of the present invention.

Preferably, the last 0.4 mm of the plunger 14 closest the first end 16 of the plunger 14 has a taper 57 about its circumference, as shown exaggerated in FIG. 2. The taper 57 is preferably at an angle 61 of about 1 to 3 degrees. Without the taper 57, when the engine valve 12 is closing and the first end 16 of the plunger 14 covers the metering edge 29 closing off the bores 28, a large pressure spike is created in the hydraulic cavity 52 which can cause the plunger 14 and engine valve 12 to bounce, possibly hitting the engine piston. The taper 57 allows the plunger 14 to close off the bores 28 gradually, thereby decreasing or eliminating the pressure spike.

An alternative embodiment of the present invention is shown in FIG. 2, in which the same reference numerals are used to identify similar features as shown in FIG. 1. In this embodiment, there is no insert but instead the plunger 14 is housed solely within the valve body 24. Also, in this embodiment, the snubbing valve 10 is located a further distance upstream from the plunger 14. Also, instead of having keyholes in the insert to allow fluid flowing around the check 36 to communicate with the plunger 14, four keyhole slots 59 (only three of which are shown) are formed in the bottom 50 of the check 36 so that when the check 36 is seated on the first seat 34, fluid flowing around the check 36 through the flow passages 56 will flow through the keyhole slots 59 into the hydraulic cavity 52. In addition, there is no orifice in the check 36 but instead a snubbing passage 54 in the form of a keyhole slot is provided at the top 48 of the check 36. Also, in this embodiment, there is no second rail, the high pressure fluid in the hydraulic cavity 52 being supplied completely by the first rail 40 through the flow passages 56 around the check 36. In place of the second rail, a drain rail 60 is provided to receive the fluid pumped out of the hydraulic cavity 52 when the engine valve is moving in the direction from its second position toward its first position. The drain rail 60 has a hinged flap 62 that is spring biased to its open position (shown closed). The spring 64 is sized so that the force of the high pressure fluid will close the flap 62 when high pressure fluid is being communicated from the high pressure fluid source, through the first rail 40, around the check 36 and into the hydraulic cavity 52 but will open the flap 62 and cause it to stay open when the high pressure fluid is not in communication with the first rail 40, so as to drain the hydraulic cavity as the engine valve returns to the closed position until the plunger 14 overlaps and closes the drain rail opening 66, whereupon the fluid in the cavity 52 is forced through the snubbing passage 54 thereby slowing the engine valve 12 over a short distance just prior to seating.

Figure 3:
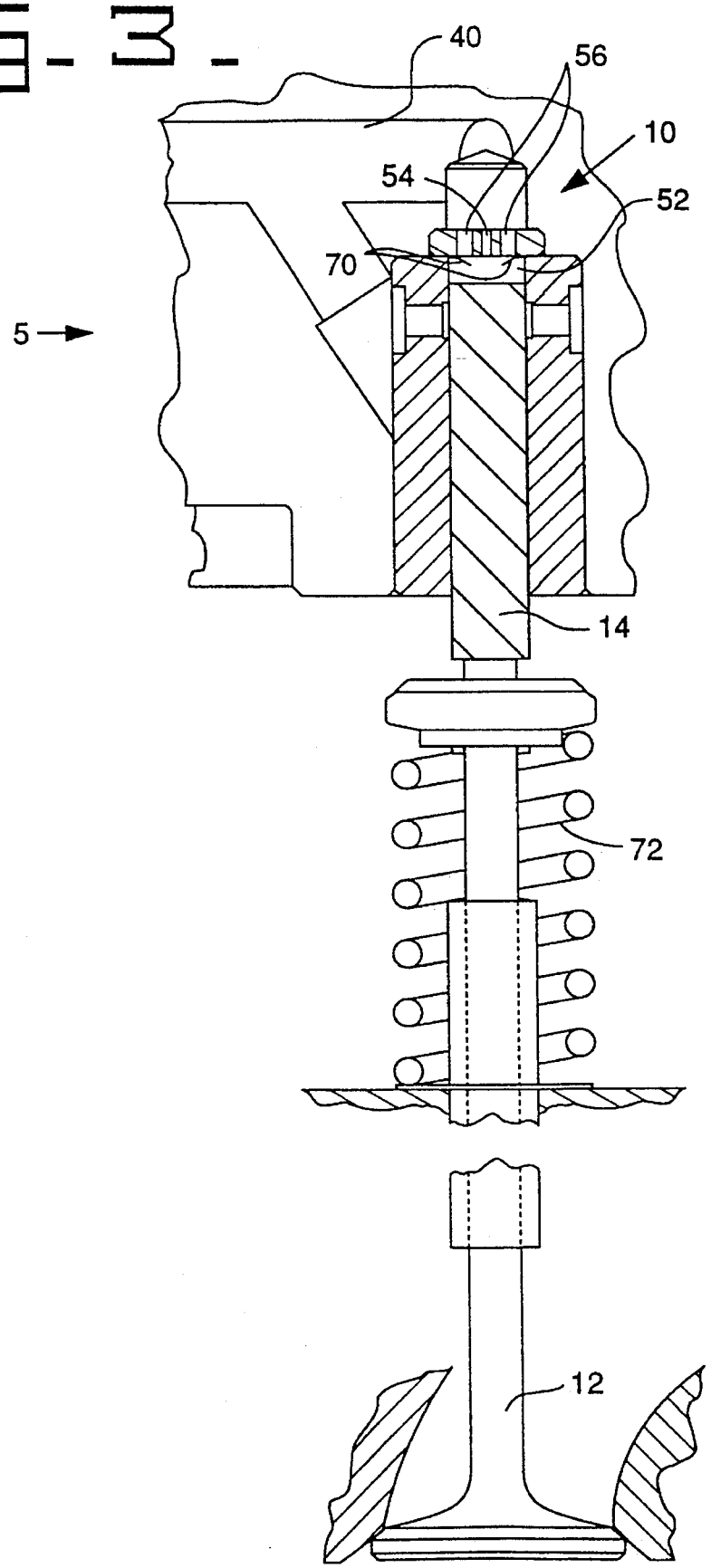
FIG. 3 is an elevational cross-sectional view of another alternative embodiment of a system of the present invention.

Another alternative embodiment of a snubbing valve 10 of the present invention is shown in FIG. 3. In this embodiment the snubbing valve 10 does not include a check, but instead, the snubbing valve 10 is a fixed position structure. Fluid flow from the first rail 40 to the hydraulic cavity 52 is through the flow passages 56 which in this case are openings having a hinged flap 70 on their bottom end. Restricted fluid flow from the hydraulic cavity 52 to the first rail 40 is through the snubbing orifice 54.

Industrial Applicability

The following description of the functioning of the snubbing valve 10 shown in FIG. 1 begins with the engine valve 12 at its first closed position, low pressure fluid in the common, first and second rails 44,40,42, low pressure fluid in the hydraulic cavity 52, and the check 36 bearing against the first seat 34.

When the engine is started, the spool valve will be switched to cut off communication of the common rail 44 with the low pressure fluid supply, and to communicate the high pressure fluid supply with the common rail 44. The high pressure fluid will travel into the first and second rails 40,42, through the flow passages 56 around the check 36, through the keyhole slots 32 in the insert 20, and fill the hydraulic cavity 52 with high pressure fluid. As used herein, the term "around the check 36" is intended to include any type of flow from the top 48 to bottom 50 or bottom 50 to top 48 of the check 36, including flow around the perimeter of the check 36 as well as flow through openings in the check 36. The high pressure fluid in the hydraulic cavity 52 will overcome the engine valve return spring 72 bias and begin displacement of the engine valve 12 from its first (seated) position toward its second (open) position. After the engine valve 12 has moved a first portion of displacement from its first position toward its second position, about 2 mm, the first end 16 of the plunger 14 will clear the metering edge 29 of the second annulus 27 allowing an even greater supply of high pressure fluid to flow into the hydraulic cavity 52 from the second rail 42 and quickly open the engine valve 12 to full open without any undue hydraulic restrictions. The engine valve 12 will open until the force of the return spring 72 and the hydraulic pressure are in equilibrium or until the engine valve 12 hits a physical stop.

When the engine valve 12 is to be closed, the spool valve is switched to turn off high pressure fluid communication with the common rail 44 and turn on low pressure fluid communication. The low pressure fluid is used for no other purpose except to prevent cavitation in the rails 44,40,42 and hydraulic cavity 52 when the high pressure fluid is off. When the high pressure fluid is turned off, the hydraulic pressure in the hydraulic cavity 52 and the force of the return spring 72 are no longer in equilibrium, and the force of the return spring 72 begins to return the engine valve 12 towards the closed position. Because there is now low pressure fluid above the check 36 and higher pressure fluid below the check 36, due to the fact that the fluid in the hydraulic cavity 52 is being somewhat pressurized by the plunger 14 as the engine valve 12 returns toward its closed position, the check 36 travels about 0.25 mm and quickly seats against the second seat 58. As the engine valve 12 continues toward its closed position, some of the fluid in the hydraulic cavity 52 is forced through the snubbing orifice 54 in the check 36, however, during a first portion of displacement of the engine valve 12 from its second position towards its first position, most of the fluid is pumped out through the bores 28 in the insert 20 and into the second rail 42 at a first rate, the second rail 42 now serving as a high pressure fluid drain, like the drain 60 of the second embodiment shown in FIG. 2.

As the top or first end 16 of the plunger 14 passes the metering edge 29 of the second annulus 27, fluid communication of the hydraulic cavity 52 with the second rail 42 is closed off and the snubbing action of the snubbing valve 10 and deceleration of the engine valve 12 begins. During this second portion of displacement of the engine valve 12 from its second (open) position towards its first (closed) position, in this case the last 2 mm, the return spring 72 continues to close the valve 12, however, flow out of the hydraulic cavity 52 is restricted to a second rate less than the first rate, the only flow passage for the fluid in the hydraulic cavity 52 being through the snubbing orifice 54, thus creating hydraulic pressure in the hydraulic cavity 52 of sufficient magnitude to decelerate the engine valve 12 to a desired velocity before impacting the engine valve seat 74. Once the engine valve 12 has closed, the cycle is complete and ready for repeat.

Depending on the dwell time before the beginning of the next cycle, the relatively high hydraulic pressure remaining in the hydraulic cavity 52 may or may not dissipate fully through the snubbing orifice 54, which will or will not, respectively, allow the check 36 to move the approximately 0.25 mm from the second seat 58 to the first seat 34 before the beginning of the next cycle. Whether the check 36 seats on the first seat 34 before the beginning of the next cycle is not critical since the pressure of the hydraulic fluid that will enter the first rail 40 will by nature be greater than the hydraulic pressure remaining in the hydraulic cavity 52 and this differential in pressure will force the check 36 to the first seat 34.

The embodiment of the present invention shown in FIG. 2 functions in a similar manner, except all high pressure fluid is supplied through the first rail 40 since there is no second rail and during return of the engine valve 12 from its open position toward its closed position, hydraulic fluid in the hydraulic cavity 52 is drained through the drain rail 60 until the plunger closes off the opening 66, whereupon the rest of the fluid is snubbed through the snubbing passage 54.

The embodiment of the present invention shown in FIG. 3 functions in a similar manner. When high pressure fluid flows into the first rail 40 it flows through the flapped openings 56 of the snubbing valve 10 and forces the flaps 70 open. When the high pressure fluid is off, the differential pressure between the high pressure fluid remaining below the snubbing valve 10 and the low pressure fluid above the snubbing valve 10 forces the flaps 70 close. Then the snubbing orifice 54 acts to decelerate the engine valve 12 in the same manner previously described.

Other aspects, objects, and advantages of this invention can be obtained from a study of the drawings, the disclosure, and the appended claims.

I claim:

1. A hydraulically actuated engine poppet valve assembly, comprising an engine valve body (24), a valve insert (20) including a first bore (18) and being disposed in a second bore (22) formed in the engine valve body (24), an engine poppet valve (12) movably disposed in said first bore (18) between first and second positions, said engine poppet valve (12) defining a hydraulic cavity (52) in said first bore (18) and being actuatable toward said second position in response to fluid pressure in said hydraulic cavity (52), and means for communicating first and second rates of fluid flow with said hydraulic cavity (52), said first rate of fluid flow pressurizing said hydraulic cavity (52) and actuating said engine poppet valve (12) toward said second position and said second rate of fluid flow restricting fluid flow from said hydraulic cavity (52) and slowing movement of said engine poppet valve (12) toward said first position, characterized by:

said means for communicating first and second rates of fluid flow including a check valve member (36) engageable and disengageable with a first check valve seat (34), a second check valve seat (58), said valve insert(20) defining said first check valve seat (34) and said second bore (22) defining said second check valve seat (58) at an end thereof opposite said first check valve seat (34), said check valve member (36) being movably disposed in said second bore (22) between said first check valve seat (34) and said second check valve seat (58), said check valve member (36) including a secondary passage (54) adapted for flowing said second rate of fluid flow thereacross when said check valve member (36) is engaged with said second check valve seat (58).

2. The hydraulically actuated engine poppet valve assembly of claim 1, wherein said means for communicating first and second rates of fluid flow includes first passage means (40) disposed in said valve body (24) in fluid communication with said second check valve seat (58), said first passage means (40) being adapted for supplying pressurized fluid to said second bore (22).

3. The hydraulically actuated engine poppet valve assembly of claim 2, wherein said means for communicating first and second rates of fluid flow includes second passage means (26,27,28) disposed in said valve insert (20) for providing fluid communication therethrough, and third passage means (42) disposed in said valve body (24) for providing fluid communication with said second passage means (26,27,28) said second passage means (26,27,28) and said third passage means (42) being adapted for exhausting pressurized fluid from said first bore (18).

4. The hydraulically actuated engine poppet valve assembly of claim 3, wherein said valve insert (20) defines said first check valve seat (34) at a first end (30) thereof, said first end (30) including primary passages (32) therein adapted for flowing said first rate of fluid flow to said first bore (18) when said check valve member (36) is seated against said first check valve seat (34).

5. The hydraulically actuated engine poppet valve assembly of claim 4, wherein said check valve member (36) is a flat check having a top surface (48) and a bottom surface (50) and said primary passages (32) are keyhole slots disposed in said first end (30) radially outward of said check valve member (36) when said bottom surface (50) is seated on said first check valve seat (34), said keyhole slots extending between said first end (30) and said first bore (18).

6. The hydraulically actuated engine poppet valve assembly of claim 5, wherein said secondary passage (54) extends between said top surface (48) and said bottom surface (50).

7. A hydraulically actuated engine poppet valve assembly comprising:

(a) an engine valve body (24);

(b) a valve insert (20) having a first bore (18) and being disposed in a second bore (22) formed in said engine valve body (24);

(b') an engine poppet valve (12) movably disposed in said first bore (18) for movement between a first position and a second position;

(c) said engine poppet valve (12) forming a hydraulic cavity (22,52) with said first bore (18) and being actuatable toward its second position in response to fluid pressure in the hydraulic cavity (22,52); and (d) means for communicating first and second rates of fluid flow with the hydraulic cavity (22,52), the first rate of fluid flow pressurizing the hydraulic cavity (22,52) and actuating said engine poppet valve (12) toward its second position and the second rate of fluid flow restricting fluid flow from within the hydraulic cavity (22,52) and slowing movement of said engine poppet valve (12) toward its first position, (e) wherein said means for communicating first and second rates of fluid flow includes a check valve member (36) movable against a first check valve seat (34) defined by said valve insert (20) and against a second check valve seat (58) defined by said second bore (22), said check valve member (36) including a secondary passage (54) adapted for flowing the second rate of fluid flow thereacross when said check valve member (36) is seated against said second check valve seat (58).

* * * * *